US010254668B2

(12) United States Patent
Yamauchi et al.

(10) Patent No.: US 10,254,668 B2
(45) Date of Patent: Apr. 9, 2019

(54) TONER FOR ELECTROPHOTOGRAPHY, DEVELOPER FOR ELECTROPHOTOGRAPHY, IMAGE FORMING APPARATUS, AND PROCESS CARTRIDGE

(71) Applicants: Yoshitaka Yamauchi, Shizuoka (JP); Hisashi Nakajima, Shizuoka (JP); Kazumi Suzuki, Shizuoka (JP); Namie Suzuki, Shizuoka (JP)

(72) Inventors: Yoshitaka Yamauchi, Shizuoka (JP); Hisashi Nakajima, Shizuoka (JP); Kazumi Suzuki, Shizuoka (JP); Namie Suzuki, Shizuoka (JP)

(73) Assignee: Ricoh Company, Ltd, Tokyo (JP)

( * ) Notice: Subject to any disclaimer, the term of this patent is extended or adjusted under 35 U.S.C. 154(b) by 0 days.

(21) Appl. No.: 15/696,818

(22) Filed: Sep. 6, 2017

(65) Prior Publication Data

US 2018/0067409 A1 Mar. 8, 2018

(30) Foreign Application Priority Data

Sep. 8, 2016 (JP) ..... 2016-175889

(51) Int. Cl.

| | |
|---|---|
| ***G03G 9/08*** | (2006.01) |
| ***G03G 9/087*** | (2006.01) |
| *G03G 15/08* | (2006.01) |

(52) U.S. Cl.

CPC ..... *G03G 9/0821* (2013.01); *G03G 9/08755* (2013.01); *G03G 9/08782* (2013.01); *G03G 9/08795* (2013.01); *G03G 9/08797* (2013.01); *G03G 15/08* (2013.01)

(58) Field of Classification Search

CPC ... G03G 9/0821; G03G 9/08755; G03G 15/08

See application file for complete search history.

(56) References Cited

U.S. PATENT DOCUMENTS

| | | | | |
|---|---|---|---|---|
| 5,679,490 | A * | 10/1997 | Yachi | G03G 9/0806 430/108.4 |
| 2010/0330486 | A1* | 12/2010 | Zhou | G03G 9/0802 430/108.4 |
| 2015/0227073 | A1* | 8/2015 | Imamoto | G03G 9/08755 430/105 |
| 2016/0077455 | A1 | 3/2016 | Moriya et al. | |

FOREIGN PATENT DOCUMENTS

| | | | |
|---|---|---|---|
| JP | 2002-278138 | A | 9/2002 |
| JP | 2003-098742 | A | 4/2003 |
| JP | 2009-229697 | A | 10/2009 |
| JP | 2016-057591 | A | 4/2016 |

* cited by examiner

*Primary Examiner* — Thorl Chea

(74) *Attorney, Agent, or Firm* — Oblon, McClelland, Maier & Neustadt, L.L.P.

(57) ABSTRACT

A toner for electrophotography, the toner including an amorphous polyester resin, an addition polymerization-based resin, and wax that is ester wax or carnauba wax, wherein the toner satisfies relationships represented by Formula 1 and Formula 2 below, $$SPr > SPw > SPd \quad \text{(Formula 1)}$$

$$|SPr - SPw| > |SPw - SPd| \quad \text{(Formula 2)}$$

where SPr is a value of a solubility parameter of the amorphous polyester resin, SPw is a value of a solubility parameter of the wax, and SPd is a value of a solubility parameter of the addition polymerization-based resin.

7 Claims, 2 Drawing Sheets

TONER FOR ELECTROPHOTOGRAPHY, DEVELOPER FOR ELECTROPHOTOGRAPHY, IMAGE FORMING APPARATUS, AND PROCESS CARTRIDGE

CROSS-REFERENCE TO RELATED APPLICATIONS

The present application claims priority under 35 U.S.C. § 119 to Japanese Patent Application No. 2016-175889 filed Sep. 8, 2016. The contents of which are incorporated herein by reference in their entirety.

BACKGROUND OF THE INVENTION

Field of the Invention

The present disclosure relates to a toner for electrophotography, a developer for electrophotography, an image forming apparatus, and a process cartridge.

Description of the Related Art

In image formation performed by an electrophotography system, electrostatic recording, or electrostatic printing, a latent image formed of electrostatic charge is formed on a photoconductor of a photoconductive material etc., a charged toner is deposited on the electrostatic latent image to form a visible image, and the visible image is then transferred to a recording medium, such as paper, followed by fixing the visible image onto the recording medium, to thereby form an output image.

As a method for fixing a toner image on paper etc. in a dry system, a contact heat method using a heat roller or a belt, etc., is typically used. The contact heat method has a high heat efficiency and enables high-speed fixing. On the other hand, the contact heat method has a problem that a so-called offset phenomenon, where part of a toner image is deposited on a surface of a fixing roller and transferred onto a recording medium sent for following image formation, tends to occur, because a surface of the heat roller and the toner in a melted state are brought into contact under the pressure. For the purpose of preventing the above-mentioned offset phenomenon, proposed is to include wax in a toner.

When wax is included in a toner, however, the following problems are caused. An adhesive force of the toner increases to lower transfer properties of the toner to the recording medium, and the wax in the toner pollutes a friction charging member, such as a carrier, to lower charging ability of the charging member, to degrade a durability.

Therefore, proposed is to add a resin incompatible to a main component of a binder resin to a toner including the binder resin and wax in order to finely disperse the wax in the toner (see, for example, Japanese Patent No. 4718738). Moreover, disclosed is a toner including a polyester resin using hydroxyl acid including 3 or more hydroxyl groups and carboxy groups in total as a monomer, an addition polymerization-based resin, and wax having an SP value of 8.2 or greater (see, for example, Japanese Unexamined Patent Application Publication No. 2009-229697).

SUMMARY OF THE INVENTION

According to one aspect of the present disclosure, a toner for electrophotography includes an amorphous polyester resin, an addition polymerization-based resin, and wax that is ester wax or carnauba wax. The toner satisfies relationships represented by Formula 1 and Formula 2 below:

$$SPr > SPw > SPd \quad \text{(Formula 1)}$$

$$|SPr - SPw| > |SPw - SPd| \quad \text{(Formula 2)}$$

In Formula 1 and Formula 2, SPr is a value of a solubility parameter of the amorphous polyester resin, SPw is a value of a solubility parameter of the wax, and SPd is a value of a solubility parameter of the addition polymerization-based resin.

DESCRIPTION OF THE EMBODIMENTS

Figure 1:
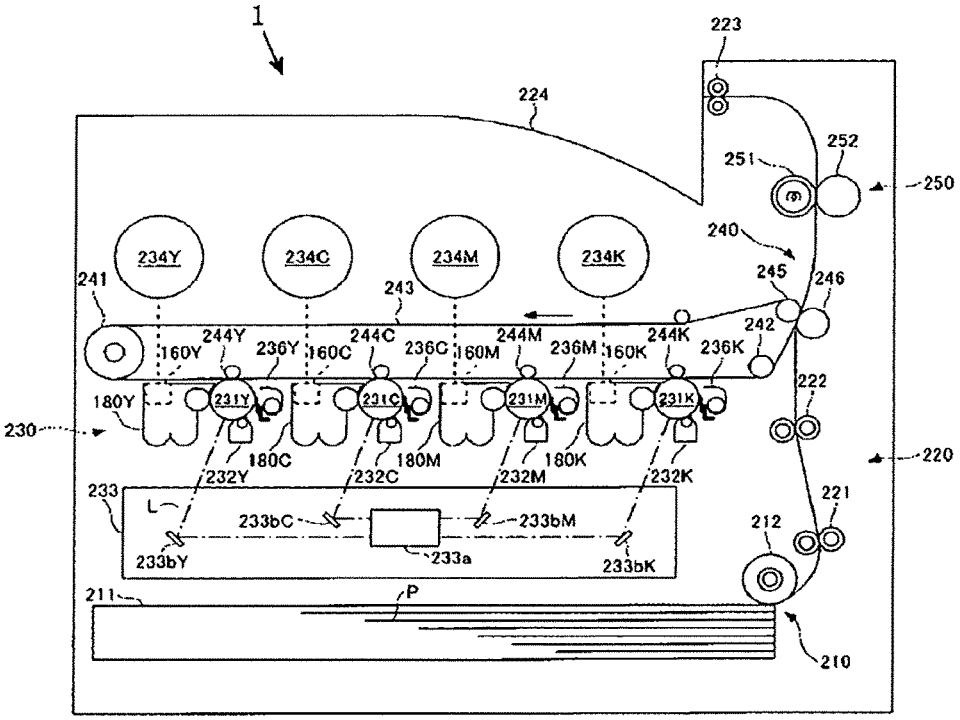
FIG. 1 is a schematic view illustrating one example of an image forming apparatus of the present disclosure.

The present disclosure has an object to provide a toner for electrophotography having excellent transfer properties, durability, toner grindability, and charging stability, while having heat-resistant storage stability.

The present disclosure can provide a toner for electrophotography having excellent transfer properties, durability, toner grindability, and charging stability, while having heat-resistant storage stability.

(Toner for Electrophotography)

A toner for electrophotography (may be also referred to as a "toner") of the present disclosure includes an amorphous polyester resin, an addition polymerization-based resin, and wax that is ester wax or carnauba wax. The toner may further include other components according to the necessity.

The toner of the present disclosure satisfies relationships represented by Formula 1 and Formula 2 below.

$$SPr > SPw > SPd \quad \text{(Formula 1)}$$

$$|SPr - SPw| > |SPw - SPd| \quad \text{(Formula 2)}$$

In Formula 1 and Formula 2, SPr is a value of a solubility parameter of the amorphous polyester resin, SPw is a value of a solubility parameter of the wax, and SPd is a value of a solubility parameter of the addition polymerization-based resin.

The toner is a toner having excellent transfer properties, durability, toner grindability, and charging stability while having heat-resistant storage stability. Note that, in the present specification, the expression "excellent heat-resistant storage stability" means that heat-resistant storage stability of the toner is excellent compared to a toner in which certain wax satisfying Formula 1 and Formula 2 above is not used.

With the toner disclosed in Japanese Patent No. 4718738, dispersibility of wax in the toner is excellent. However, diameters of dispersed wax particles are slightly large relative to the toner particle diameter because the SP values of a main resin, a dispersed resin, and the wax are in the state of the main resin>the dispersed resin>the wax. Therefore, further improvements are desired.

With the toner disclosed in Japanese Unexamined Patent Application Publication No. 2009-229697, moreover, dispersibility of wax in the toner is excellent, but a deterioration in charging stability may be caused by a deterioration in humidity resistance, because a polyester resin including many hydroxyl groups or carboxy groups is used.

The present disclosure is an invention accomplished in order to solve the above-described problems in the art.

Since the toner of the present disclosure satisfies the relationship represented by Formula 1, the amorphous polyester resin and the addition polymerization-based resin are incompatible to each other to form a see-island phase separation structure, and a state where the addition polymerization-based resin in the form of islands is dispersed in the amorphous polyester resin of a continuous phase in the form of sea is realized.

When the relationship represented by Formula 1 is not satisfied as in the toner in the art, i.e., SPr>SPd>SPw, the amorphous polyester resin and the addition polymerization-based resin are partially compatible to each other, and therefore it is difficult to form excellent domains of the addition polymerization-based resin in the amorphous polyester resin in the form of sea. As a result, a dispersion state of the wax in the above-mentioned toner in the art is inferior to the structure of the toner of the present disclosure. Therefore, transfer properties, durability, toner grindability, and environmental stability of charging of the above-mentioned toner in the art are poor.

When the relationship represented by Formula 2 is satisfied, moreover, the wax is included into the addition polymerization-based resin having the similar SP value to the SP value of the wax, and as a result, an excellent dispersion state of the wax can be realized.

In the case where the relationship represented by Formula 2 is not satisfied and the relationship of $|SPr-SPw|<|SPw-SPd|$ is satisfied, the wax is easily compatible to the amorphous polyester resin, and therefore not only transfer properties, durability, and toner grindability, but also heat-resistant storage stability becomes insufficient.

A value of $|SPr-SPw|$ is preferably 1.5 or greater but 3.5 or less and more preferably 2.0 or greater but 3.0 or less. A value of $|SPw-SPd|$ is preferably 0.1 or greater but 1.4 or less and more preferably 0.3 or greater but 1.2 or less.

An SP value (solubility parameter: δ) for use in the present disclosure is defined by the following formula according to the Hildebrand-Scatchard solution theory.

$$\delta=(\Delta Ev/V)^{1/2}$$

In the formula above, ΔEv is evaporation energy, V is a molecular volume, and ΔEv/V is cohesive energy density.

Examples of a method for determining an SP (solubility parameter) value include the method of Small et al., and the method of Fedor et al. The details of the method of Small et al. are described in, for example, P. A. Small, J. Appl. Polym. Sci., 3 (1953) 71. The details of the method of Fedor et al. are described in, for example, Study of Coating Material No. 152 October 2010 "Examination associated to solubility parameter of additive."

Since the toner of the present disclosure satisfies the relationships represented by Formula 1 and Formula 2, a structure where the addition polymerization-based resin in the form of islands is dispersed in the amorphous polyester resin in the form of sea and wax is included in the addition polymerization-based resin in the form of islands. Therefore, grindability is improved because grinding stress is also concentrated to an interface between the amorphous polyester resin and the addition polymerization-based resin. Moreover, an amount of the wax exposed to a surface of the ground toner particle can be reduced, and therefore excellent transfer properties and durability are achieved.

<Amorphous Polyester Resin>

An amorphous polyester resin is not particularly limited and may be appropriately selected depending on the intended purpose, but the amorphous polyester resin preferably includes a constitutional unit derived from an aromatic compound.

The aromatic compound is not particularly limited and may be appropriately selected depending on the intended purpose. Examples of the aromatic compound include alkylene oxide adducts of bisphenol A, isophthalic acid, terephthalic acid, and derivatives of the foregoing compounds.

An amount of the constitutional unit derived from the aromatic compound in the amorphous polyester resin is preferably 50% by mass or greater. When the amount is 50% by mass or greater, problems, such as reduction in a charging ability of a toner, can be prevented.

A method for determining a constitutional unit of the amorphous polyester resin is not particularly limited. For example, the constitutional unit can be determined by the following method. A toner is weighed by about 5 g. To the toner, 100 g of toluene is added, the resultant mixture is left to stand for 24 hours, and the resultant toner solution that has been sufficiently dissolved is separated by centrifugation. Thereafter, the supernatant is dried to obtain solids of the supernatant. The obtained solids are subjected to a component analysis through GC-MS to determine a constitutional unit (monomer composition). Based on information of the obtained monomer composition, a quantitative analysis is performed by $^{1}H$ NMR and $^{13}C$ NMR to determine a structure of the amorphous polyester resin.

A solubility parameter (SPr value) of the amorphous polyester resin can be determined by the Small method or the Fedor method based on the composition of the amorphous polyester resin obtained by the above-described method.

Glass transition temperature of the amorphous polyester resin is preferably from 45° C. through 75° C. and more preferably from 50° C. through 70° C. When the glass transition temperature of the amorphous polyester resin is 45° C. or higher, a resultant toner has excellent heat-resistant storage stability. When the glass transition temperature of the amorphous polyester resin is 75° C. or lower, a resultant toner has excellent low-temperature fixing ability.

A softening point of the amorphous polyester resin is preferably from 90° C. through 150° C. and more preferably from 90° C. through 130° C. When the softening point of the amorphous polyester resin is 90° C. or higher, a resultant toner has excellent heat-resistant storage stability. When the softening point of the amorphous polyester resin is 150° C. or lower, a resultant toner has excellent low-temperature fixing ability.

A weight average molecular weight of the amorphous polyester resin is preferably from 1,000 through 100,000, more preferably from 2,000 through 50,000, and even more preferably from 3,000 through 10,000. When the weight average molecular weight of the amorphous polyester resin is 1,000 or greater, a resultant toner has excellent heat-resistant storage stability. When the weight average molecular weight of the amorphous polyester resin is 100,000 or less, a resultant toner has excellent low-temperature fixing ability.

Note that, the weight average molecular weight of the amorphous polyester resin is a polystyrene-conversion molecular weight measured by gel permeation chromatography.

An amount of the amorphous polyester resin is not particularly limited and may be appropriately selected depending on the intended purpose. The amount of the amorphous polyester resin is preferably from 75 parts by mass through 95 parts by mass and more preferably from 80 parts by mass through 90 parts by mass, relative to 100 parts by mass of the toner. When the amount is 75 parts by mass or greater, problems, such as poor dispersibility of wax in the toner, which leads to smearing or disturbance of an image, can be prevented. When the amount is 95 parts by mass or less, a problem of poor low-temperature fixing ability can be prevented.

<Wax>

The wax is ester wax or carnauba wax. The wax is preferably ester wax.

The toner may include another wax in addition to the above-mentioned wax.

For example, the toner may include carnauba wax that is not a target of the SPw, in addition to ester wax that is a target of the SPw. Also, in addition to ester wax that is a target of the SPw, the toner may include wax that is not a target of the SPw and is neither the ester wax nor the carnauba wax.

In the case where the toner includes two or more types of wax, a solubility parameter value (SPw) of each wax preferably satisfies Formula 1 and Formula 2.

Since the ester wax has sharp heat melting properties, the ester wax is suitable for a low-temperature-fixing toner. Since the ester wax has low compatibility to the amorphous polyester resin, the ester wax has an effect of improving heat-resistant storage stability.

A method for analyzing a type of wax included in the toner is not particularly limited. For example, the type of wax included in the toner can be determined in the following manner. A toner is weighed by about 5 g. To the toner, 100 g of toluene is added, the resultant mixture is left to stand for 24 hours, and the resultant toner solution that has been sufficiently dissolved is subjected to centrifugation and decantation to separate insoluble matter. To 1 g of the obtained insoluble matter, 20 g of chloroform is added, and the resultant mixture is left to stand for 24 hours. The resultant solution that has been sufficiently dissolved is subjected to centrifugation to remove insoluble matter, and the supernatant is dried to obtain solids of the supernatant. The obtained solids are subjected to a component analysis through pyrolysis-gas chromatography-mass spectrometry (Py-GCMS) to determine a type of wax.

A solubility parameter (SPw value) of the wax can be determined from the type of the wax determined by the method above using the method of Small or the method of Fedor.

When an ionic strength ratio of each carbon number of the ester wax is represented with a percentage, an amount of an ester compound having the carbon number having a maximum ionic strength ratio (may be referred to as "purity of a main component of the ester wax" hereinafter) is preferably 60% by mass or greater relative to a total amount of the wax.

When the purity of the main component of the ester wax is 60% by mass or greater, the SPw value of the entire wax becomes constant and excellent dispersibility of the wax can be achieved because the SP values of the amorphous polyester resin, the wax, and the addition polymerization-based resin are clearly different from each other. Therefore, excellent transfer properties, durability, and toner grindability are achieved.

A measuring method of an ionic strength ratio of each carbon number of the ester wax is not particularly limited. For example, the ionic strength ratio of each carbon number of the ester wax can be determined in the following manner. A toner is weighed by about 5 g. To the toner, 100 g of toluene is added, the resultant mixture is left to stand for 24 hours, and the resultant toner solution that has been sufficiently dissolved is subjected to centrifugation and decantation to separate insoluble matter. To 1 g of the obtained insoluble matter, 20 g of chloroform is added, and the resultant mixture is left to stand for 24 hours. The resultant solution that has been sufficiently dissolved is subjected to centrifugation to remove insoluble matter, and the supernatant is dried to obtain solids of the supernatant. The obtained solids are measured by mass spectrometry to determine an ionic strength ratio of each carbon number.

When an ionic strength ratio of each carbon number of the ester wax is represented with a percentage, an ester compound having the carbon number having a maximum ionic strength ratio is preferably monoester wax. Use of the monoester wax can reduce the number of hydrophilic functional groups in the wax. Therefore, the monoester wax is preferable because environmental stability of charging can be improved.

As the ester wax, ester wax appropriately synthesized may be used or a commercial product of ester wax may be used.

The ester wax is typically synthesized through an esterification reaction between long-chain fatty acid or polyvalent carboxylic acid, and long-chain higher alcohol or polyvalent alcohol.

The long-chain fatty acid or polyvalent carboxylic acid and the long-chain higher alcohol or polyvalent alcohol are generally obtained from natural products and are each a mixture having even carbon numbers.

The long-chain fatty acid is not particularly limited and may be appropriately selected depending on the intended purpose. Examples of the long-chain fatty acid include myristic acid, palmitic acid, stearic acid, arachidic acid, behenic acid, and lignoceric acid. The above-listed examples may be used alone or in combination.

Examples of the polyvalent carboxylic acid include: benzene dicarboxylic acids, such as phthalic acid, isophthalic acid, and terephthalic acid, and anhydrides of benzene dicarboxylic acids; alkyl dicarboxylic acids, such as succinic acid, adipic acid, sebacic acid, and azelaic acid, and anhydrides of alkyl dicarboxylic acid; unsaturated dibasic acid, such as maleic acid, citraconic acid, itaconic acid, alkenyl succinic acid, fumaric acid, and mesaconic acid; unsaturated dibasic anhydrides, such as maleic anhydride, citraconic anhydride, itaconic anhydride, and alkenyl succinic anhydride; trimellitic acid; pyromellitic acid; 1,2,4-benzenetricarboxylic acid; 1,2,5-benzenetricarboxylic acid; 2,5,7-naphthalenetricarboxylic acid; 1,2,4-naphthalenetricarboxylic acid; 1,2,4-butanetricarboxylic acid; 1,2,5-hexanetricarboxylic acid; 1,3-dicarboxy-2-methyl-2-methylenecarboxypropane; tetrakis(methylenecarboxy)methane; 1,2,7,8-octanetetracarboxylic acid; Empol trimer acid; anhydrides of the foregoing acids; and partial lower alkyl esters. The above-listed examples may be used alone or in combination.

The long-chain higher alcohol is not particularly limited and may be appropriately selected depending on the intended purpose. Examples of the long-chain higher alcohol include capryl alcohol, capric alcohol, lauryl alcohol, myristyl alcohol, cetyl alcohol, stearyl alcohol, arachidyl alcohol, behenyl alcohol, and lignoceryl alcohol. The above-listed examples may be used alone or in combination.

Examples of the polyvalent alcohol include ethylene glycol, propylene glycol, 1,3-butanediol, 1,4-butanediol, 2,3-butanediol, diethylene glycol, triethylene glycol, 1,5-pentanediol, 1,6-hexanediol, neopenthyl glycol, 2-ethyl-1,3-hexanediol, sorbitol, 1,2,3,6-hexanetetrol, 1,4-sorbitan, pentaerythritol, dipentaerythritol, tripentaerythritol, 1,2,4-butanetriol, 1,2,5-pentatriol, glycerin, 2-methylpropanetriol, 2-methyl-1,2,4-butanetriol, trimethylol ethane, trimethylol propane, and 1,3,5-trihydroxybenzene. The above-listed examples may be used alone or in combination.

For example, the esterification reaction is performed at a reaction temperature of lower than 250° C. under normal pressure or reduced pressure, preferably in inert gas, such as nitrogen. A reaction ratio between the long-chain fatty acid or polyvalent carboxylic acid and the long-chain higher alcohol or polyvalent alcohol is not particularly limited and may be appropriately selected depending on the intended purpose. At the time of the esterification reaction, a small amount of an esterification catalyst or a solvent may be present in the reaction system.

As the esterification catalyst, for example, an organic titanium compound (e.g., tetrabutoxy titanate and tetrapropioxy titanate), an organic tin compound (e.g., butyltin dilaurate and dibutyltin oxide), and others (e.g., an organic lead compound and sulfuric acid) are used. As the solvent, for example, an aromatic solvent (e.g., toluene, xylene, and mineral spirit) is used.

In the case where the long-chain fatty acid or polyvalent carboxylic acid and the long-chain higher alcohol or polyvalent alcohol are directly reacted to perform esterification, various by-products having similar structures are generated other than a target ester compound, and therefore such the by-products tend to adversely affect various properties of a resultant toner. Therefore, ester wax for use in the present disclosure can be obtained by purifying raw materials or a generated product through solvent extraction or vacuum distillation.

A melting point of the wax is preferably 63° C. or higher but 78° C. or lower. When the melting point is 63° C. or higher, a deterioration in heat-resistant storage stability can be prevented. When the melting point is 78° C. or lower, a deterioration in low-temperature fixing ability can be prevented.

An amount of the wax in the toner is not particularly limited and may be appropriately selected depending on the intended purpose. The amount is preferably from 3 parts by mass through 10 parts by mass and more preferably from 5 parts by mass to 8 parts by mass relative to 100 parts by mass of the amorphous polyester resin.

When the amount is 3 parts by mass or greater, a deterioration in fixing ability can be prevented. When the amount is 10 parts by mass or less, a problem that the wax tends to be fused inside a device during production of a toner through pulverization can be prevented, and the following problem during production of a toner through a polymerization method can be prevented. Namely, cohesion between toner particles tends to occur during atomizing and as a result a toner having a wide particle size distribution tends to be formed to lower durability of the toner.

<Addition Polymerization-Based Resin>

The addition polymerization-based resin is a resin obtained through an addition polymerization reaction of an addition-polymerizable monomer.

The addition-polymerizable monomer is not particularly limited and may be appropriately selected depending on the intended purpose. Examples of the addition-polymerizable monomer include vinyl-based monomers.

Examples of the vinyl-based monomers include: styrene-based vinyl monomers, such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-4-dichlorostyrene, m-nitrostyrene, o-nitrostyrene, and p-nitrostyrene; acrylic acid-based vinyl monomers, such as acrylic acid, methyl acrylate, ethyl acrylate, propyl acrylate, n-butyl acrylate, isobutyl acrylate, n-octyl acrylate, and 2-ethylhexyl acrylate; methacrylic acid-based vinyl monomers, such as methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate; and other vinyl monomers or other monomers for forming copolymers. The above-listed examples may be used alone or in combination.

The addition polymerization-based resin may be appropriately synthesized for use or a commercial product of the addition polymerization-based resin may be used. Examples of the commercial product include: BR-50, BR-52, MB-2539, BR-60, BR-64, BR-73, BR-75, MB-2389, BR-80, BR-82, BR-83, BR-84, BR-85, BR-87, BR-88, BR-90, BR-95, BR-96, BR-100, BR-101, BR-102, BR-105, BR-106, BR-107, BR-108, BR-110, BR-113, FB-676, MB-2660, MB-2952, MB-3012, MB-3015, MB-7033, BR-115, MB-2478, BR-116, BR-117, BR-118, BR-122, and ER-502 (all available from MITSUBISHI RAYON CO., LTD.); A-11, A-12, A-14, A-21, B-38, B-60, B-64, B-66, B-72, B-82, B-44, B-48N, B-67, B-99N, and DM-55 (all available from WILBUR-ELLIS); and JONCRYL 67, JONCRYL 678, JONCRYL 586, JONCRYL 611, JONCRYL 680, JONCRYL 682, JONCRYL 683, JONCRYL 690, JONCRYL 819, JDX-C3000, and JDX-C3080 (all available from BASF SE). The above-listed examples may be used alone or in combination.

A method for determining a constitutional unit of the addition polymerization-based resin is not particularly limited, but the constitutional unit can be determined, for example, by the following method. A toner is weighed by about 5 g. To the toner, 100 g of toluene is added, the resultant mixture is left to stand for 24 hours, and the resultant toner solution that has been sufficiently dissolved is separated by centrifugation. Thereafter, the supernatant is dried to obtain solids of the supernatant. The obtained solids are subjected to a component analysis through GC-MS to determine a constitutional unit (monomer composition). Based on information of the obtained monomer composition, a quantitative analysis is performed by $^{1}H$ NMR and $^{13}C$ NMR to determine a structure of the addition polymerization-based resin.

A solubility parameter (SPd value) of the addition polymerization-based resin can be determined by the Small method or the Fedor method based on the composition of the addition polymerization-based resin obtained by the aforementioned method.

An amount of the addition polymerization-based resin in the toner is preferably from 0.5 times through 1.5 times an amount of the wax, and more preferably from 0.7 times through 1.3 times an amount of the wax.

When the amount is in the range of 0.5 times through 1.5 times an amount of the wax, an excellent dispersion state of the wax can be obtained, and therefore a resultant toner has excellent transfer properties, durability, grindability, and environmental stability of charging.

<Other Components>

The above-mentioned other components are not particularly limited, and components generally used for a toner can be included. Examples of the above-mentioned other components include a crystalline polyester resin, a charge-controlling agent, a colorant, and external additives. The above-listed examples may be used alone or in combination.

<<Crystalline Polyester Resin>>

The crystalline polyester resin is a polyester resin which has a particularly high ratio of a crystal structure where main chains are regularly orientated, and changes a viscosity of the polyester resin at a temperature adjacent a melting point. When the toner includes the crystalline polyester resin, the toner can secure a wide margin against low-temperature fixing ability.

A synthesis method of the crystalline polyester resin is not particularly limited and may be appropriately selected depending on the intended purpose. Examples of the synthesis method include polycondensation between polyol and polycarboxy acid, ring-opening polymerization of lactone, polycondensation of hydroxycarboxylic acid, and ring-opening polymerization of cyclic ester having a carbon number of 4 through 12 corresponding to a dehydration condensate between two molecules or three molecules of hydroxycarboxylic acid. Among them, the crystalline polyester resin obtained through polycondensation between polyol and polycarboxylic acid is preferable. The polyol may be diol alone, or a combination of diol and trivalent or higher alcohol. Among the polycondensation between polyol and polycarboxylic acid, a crystalline polyester resin obtained through polycondensation between diol and dicarboxylic acid is preferable.

An amount of the crystalline polyester resin is not particularly limited and may be appropriately selected depending on the intended purpose.

<<Charge-Controlling Agent>>

The charge-controlling agent is not particularly limited and may be appropriately selected depending on the intended purpose. Examples of the charge-controlling agent include nigrosine, azine-based dyes including an alkyl group having a carbon number of 2 through 16 (Japanese Examined Patent Publication No. 42-1627), basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000)), lake pigments of the foregoing basic dyes, C.I. Solvent Black 8 (C.I. 26150), quaternary ammonium salts (e.g., benzoylmethylhexadecyl ammonium chloride and decyltrimethyl chloride), dialkyl tin compounds, such as of dibutyl and dioctyl, dialkyl tin borate compounds, guanidine derivatives, metal complex salts of monoazo dyes disclosed in Japanese Examined Patent Publication Nos. 41-20153, 43-27596, 44-6397, and 45-26478, metal (e.g., Zn, Al, Co, Cr, and Fe) complexes of salicylic acid, dialkyl salicylate, naphthoic acid, and dicarboxylic acid disclosed in Japanese Examined Patent Publication Nos. 55-42752 and 59-7385, sulfonated copper phthalocyanine pigments, organic boron salts, fluorine-containing quaternary ammonium salts, and calixarene-based compounds.

Note that, use of a charge-controlling agent that impairs a color should be naturally avoided in a color toner other than a black toner. In this case, the charge-controlling agent is preferably a metal salt of a salicylic derivative that is white in color.

<<Colorant>>

As a colorant used for the toner of the present disclosure, any single or combination of dyes and pigments known in the art can be used. Examples of the dyes and pigments known in the art include carbon black, lamp black, iron black, aniline blue, phthalocyanine blue, phthalocyanine green, Hanza Yellow G, Rhodamine 6C lake, Calco Oil Blue, chrome yellow, quinacridone, benzidine yellow, rose bengal, and triallyl methane-based dyes. The colorant can be used for a black toner and full color toners.

An amount of the colorant is not particularly limited and may be appropriately selected depending on the intended purpose. The amount of the colorant is preferably from 1 part by mass through 30 parts by mass and more preferably from 3 parts by mass to 20 parts by mass relative to 100 parts by mass of the amorphous polyester resin in the toner.

<<External Additives>>

The external additives are appropriately selected depending on the intended purpose. Examples of the external additives include hydrophobic treated particles of silica, titanium oxide, and alumina, and resin particles. The above-listed examples may be used alone or in combination. In addition to the external additives, moreover, a lubricant, such as particles of fatty acid metal salts and polyvinylidene fluoride, may be also used in combination.

When the external additives are included, flowability, transfer properties, etc., of the toner can be improved.

Fluctuations in a charging amount of the toner of the present disclosure due to changes in humidity can be significantly reduced by externally adding hydrophobic-treated titanium oxide to the toner. Moreover, fluctuations in a charging amount of the toner of the present disclosure due to changes in humidity can be reduced as well as improving flowability, transfer properties, etc. of the toner by externally adding hydrophobic-treated silica and hydrophobic-treated titanium oxide, and adjusting an amount of the externally added hydrophobic-treated titanium oxide larger than an amount of the externally added hydrophobic-treated silica.

Furthermore, reduction in charging ability at the time of actual use can be minimized to improve durability by externally adding hydrophobic-treated silica having a primary particle diameter of from 0.01 μm through 0.03 μm, hydrophobic-treated silica having a specific surface area of from 20 $m^2/g$ through 60 $m^2/g$, and hydrophobic-treated titanium oxide.

The hydrophobic-treated titanium oxide can be obtained by treating titanium oxide with a hydrophobic treatment agent. Examples of the hydrophobic treatment agent include dimethyl dichlorosilane, trimethyl chlorosilane, methyl trichlorosilane, allyl dimethyl dichlorosilane, allyl phenyl dichlorosilane, benzyl dimethyl chlorosilane, bromomethyldimethyl chlorosilane, α-chloroethyl trichlorosilane, p-chloroethyl trichlorosilane, chloromethyldimethyl chlorosilane, chloromethyl trichlorosilane, p-chlorophenyl trichlorosilane, 3-chloropropyl trichlorosilane, 3-chloropropyl trimethoxysilane, vinyl triethoxy silane, vinyl methoxy silane, vinyl-tris(β-methoxyethoxy)silane, γ-methacryloxypropyl trimethoxysilane, vinyl triacetoy silane, divinyl dichlorosilane, dimethyl vinyl chlorosilane, octyl-trichlorosilane, decyl-trichlorosilane, nonyl-trichlorosilane, (4-t-propylphenyl)-trichlorosilane, (4-t-butylphenyl)-trichlorosilane, dibenzyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylbenzyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyl trimethoxy silane, hexamethyl disilazane, hexaethyl disilazane, diethyl tetramethyl disilazane, hexaphenyl disilazane, hexatolyl disilazane, titanate-based coupling agents, and aluminium-based coupling agents. The above-listed examples may be used alone or in combination.

<Production Method of Toner>

The toner of the present disclosure can be produced by a method known in the art. Specifically, the toner can be produced by kneading the amorphous polyester resin, the wax, the addition polymerization-based resin, and other components, pulverizing the resultant kneaded product to obtain toner particles, and covering surfaces of the obtained toner particles with external additives.

As a device for kneading the toner of the present disclosure, any device using a method known in the art can be used. Suitably used are batch-type twin rolls, Banbury mixers or continuous twin screw extruders (e.g., KTK twin-screw extruder available from Kobe Steel, Ltd., TEM twin-screw kneader available from TOSHIBA MACHINE CO., LTD., a twin-screw extruder available from KCK, PCM twin-screw extruder available from IKEGAI, and KEX twin-screw extruder available from Kurimoto, Ltd.), and continuous single screw kneaders (e.g., a co-kneader available from BUSS).

The melt-kneaded product obtained in the above-described manner is cooled, followed by being pulverized. For example, the pulverization is performed by roughly pulverizing a hummer mill or Rotoplex, followed by finely pulverizing using a fine pulverizer using a jet flow or a mechanical fine pulverizer. The pulverization is preferably performed in a manner that an average particle diameter of the resultant particles is to be from 3 μm through 15 μm. Moreover, a particle size of the pulverized product is adjusted to from 4 μm through 20 μm by means of a wind classifier. Moreover, a production method where toner particles are directly obtained through suspension polymerization or emulsion polymerization may be also used.

Subsequently, the external additives are externally added to toner base particles. Surfaces of the toner base particles are coated with the external additives, while the external additives are crushed, by mixing and stirring the toner base particles and the external additives by means of a mixer.

(Developer)

The developer of the present disclosure includes at least the toner, and may further include appropriately selected other components according to the necessity.

The toner of the present disclosure can be used for both a one-component developer and a two-component developer.

In the case where the toner is used for a two-component developer, the toner is used by blending with carrier powder. In this case, any type of carrier powder known in the art can be used as the carrier powder. Examples of the carrier powder include iron powder, ferrite powder, magnetite powder, nickel powder, glass beads, any of the above-listed powders surfaces of which are covered with a resin.

As a resin covering surfaces of carrier powder, any resins used in the art can be used. Examples of the resin include silicone resins, styrene-acryl-based copolymers, fluororesins, and polyester resins.

A blending ratio between the toner and the carrier is not particularly limited and may be appropriately selected depending on the intended purpose. Relative to 100 parts by mass of the carrier, the toner is preferably 2 parts by mass through 10 parts by mass.

(Image Forming Apparatus and Image Forming Method)

The image forming apparatus of the present disclosure includes at least a photoconductor, a charging unit configured to charge the photoconductor, the exposure unit configured to expose the charged photoconductor to light to form an electrostatic latent image, a developing unit configured to develop the electrostatic latent image formed on the photoconductor with the developer of the present disclosure to form a toner image, a transfer unit configured to transfer the toner image formed on the photoconductor to a recording medium, and a fixing unit configured to fix the transferred toner image to the recording medium. The image forming apparatus may further include other units according to the necessity.

The image forming method in the present disclosure includes at least a charging step, an exposure step, a developing step, a transfer step, and a fixing step, and may further include other steps according to the necessity.

<Photoconductor>

A material, structure, and size of the photoconductor are not particularly limited, and appropriately selected from materials, structures, and sizes known in the art. Examples of the material of the photoconductor include inorganic photoconductors (e.g., amorphous silicon and selenium) and organic photoconductors (e.g., polysilane and phthalopolymethine). Among the above-listed examples, amorphous silicon is preferable in view of a long service life.

<<Charging Unit and Charging>>

The charging unit is not particularly limited and may be appropriately selected depending on the intended purpose. Examples of the charger include a contact charger, known in the art as itself, equipped with an electroconductive or semiconductive roller, brush, film, or rubber blade, and a non-contact charger utilizing corona discharge, such as corotron, and scorotron.

For example, the charging can be performed by applying voltage to a surface of the photoconductor using the charging unit.

A shape of the charging unit may be, other than a roller, any form, such as a magnetic brush, a fur brush, etc., and the shape can be selected depending on specifications or embodiment of the image forming apparatus.

The charging unit is not limited to the contact charging unit, but use of a contact charging unit is preferable because an image forming apparatus which has a less amount of ozone generated from the charging unit is obtained.

<<Exposure Unit and Exposure Step>>

The exposure unit is not particularly limited and may be appropriately selected depending on the intended purpose, as long as the exposure unit is capable of exposing the charged surface of the photoconductor by the charging unit to light imagewise that corresponds to an image to be formed. Examples of the exposure unit include various exposure units, such as a reproduction optical exposure unit, a rod-lens array exposure unit, a laser optical exposure unit, and a liquid crystal shutter optical unit.

A light source used for the exposure unit is not particularly limited and may be appropriately selected depending on the intended purpose. Examples of the light source include all of emitters, such as fluorescent lamps, tungsten lamps, halogen lamps, mercury lamps, sodium lamps, light-emitting diodes (LED), semiconductor lasers (LD), and electroluminescence (EL).

Moreover, various filters, such as sharp-cut filers, band-pass filers, infrared cut filters, dichroic filers, interference filters, and color conversion filters, may be used for emitting only light having a desired wavelength range.

For example, the exposure can be performed by exposing the surface of the photoconductor to light imagewise using the exposure unit.

Note that, in the present disclosure, a back light system where exposure is performed imagewise from a back side of the photoconductor may be employed.

<<Developing Unit and Developing Step>>

The developing unit is not particularly limited and may be appropriately selected depending on the intended purpose, as long as the developing unit is a developing unit that stores a toner and is configured to develop the electrostatic latent image formed on the photoconductor with the toner to form a toner image that is a visible image.

The developing step is not particularly limited and may be appropriately selected depending on the intended purpose, as long as the developing step is a step including developing the electrostatic latent image formed on the photoconductor with a toner to form a toner image that is a visible image. For example, the developing step can be performed by the developing unit.

The developing unit is preferably a developing device including a stirrer configured to frictionally stir and charge the toner to charge the toner, and a developer bearer which includes a magnetic-field-generating unit fixed inside the developer bearer, is rotatable, and bears a developer including the toner on a surface of the developer bearer.

<<Transfer Unit and Transfer Step>>

The transfer unit is not particularly limited and may be appropriately selected depending on the intended purpose, as long as the transfer unit is a unit configured to transfer the visible image to a recording medium. A preferable embodiment of the transfer unit is an embodiment where the transfer unit includes a first transfer unit configured to transfer visible images on an intermediate transfer member to form a composite transfer image, and a secondary transfer unit configured to transfer the composite transfer image onto a recording medium.

The transfer step is not particularly limited and may be appropriately selected depending on the intended purpose, as long as the transfer step is a step including transferring the visible image to a recording medium. A preferable embodiment of the transfer step is an embodiment where the transfer step uses an intermediate transfer member, and includes primary transferring visible images onto the intermediate transfer member, followed by secondary transferring the visible images onto the recording medium.

For example, the transfer step can be performed by transferring the visible images through charging the photoconductor using a transfer charger, and can be performed by the transfer unit.

In the case where an image secondary transferred onto the recording medium is a color image formed of several color toners, the transfer may be performed as follows. The transfer unit superposes the color toners on top of another on the intermediate transfer member to thereby form an image on the intermediate transfer member, and then, the image formed on the intermediate transfer member is secondarily transferred at once onto the recording member using the intermediate transfer member.

Note that, the intermediate transfer member is not particularly limited and may be selected appropriately from those known in the art depending on the intended purpose. Suitable examples of the intermediate transfer member include a transfer belt.

The transfer unit (the primary transfer unit or the secondary transfer unit) preferably includes at least a transfer device configured to charge and separate the visible image formed on the photoconductor to the side of the recording medium. Examples of the transfer device include a corona transfer device with corona discharge, a transfer belt, a transfer roller, a pressure transfer roller, and an adhesive transfer device.

Note that, the recording medium is typically plane paper, but the recording medium is not particularly limited and may be appropriately selected depending on the intended purpose, as long as an unfixed image after developing can be transferred onto the recording medium. As the recording medium, a PET base for OHP etc. can be used.

<<Fixing Unit and Fixing Step>>

The fixing unit is not particularly limited and may be appropriately selected depending on the intended purpose, as long as the fixing unit is a unit configured to fix the transferred image transferred to the recording medium. The fixing unit is preferably a heat pressure member known in the art. Examples of the heat pressure member include a combination of a heating roller and a pressure roller, and a combination of a heating roller, a pressure roller, and an endless belt.

The fixing step is not particularly limited and may be appropriately selected depending on the intended purpose, as long as the fixing step is a step including fixing a visible image transferred to the recording medium. For example, the fixing step may be performed every time a toner image of each color is transferred onto the recording medium, or the fixing step may be performed once after toner images of all colors are superimposed on top of one another on the recording medium.

The fixing step can be performed by the fixing unit.

Heating by the heat-pressure member is typically preferably performed at 80° C. through 200° C.

Note that, in the present disclosure, a known photo-fixing unit may be used in addition to or instead of the fixing unit depending on the intended purpose.

Surface pressure at the time of the fixing step is not particularly limited and may be appropriately selected depending on the intended purpose, but the surface pressure is preferably from 10 $N/cm^2$ through 80 $N/cm^2$.

<Other Units and Other Steps>

Examples of the above-mentioned other units include a cleaning unit, a charge-eliminating unit, a recycle unit, and a control unit.

Examples of the above-mentioned other steps include a cleaning step, a charge-eliminating step, a recycle step, and a control step.

<<Cleaning Unit and Cleaning Step>>

The cleaning unit is not particularly limited and may be appropriately selected depending on the intended purpose, as long as the cleaning unit is a unit capable of removing the toner remained on the photoconductor. Examples of the cleaning unit include magnetic brush cleaners, electrostatic brush cleaners, magnetic roller cleaners, blade cleaners, brush cleaners, and wave cleaners.

The cleaning step is not particularly limited and may be appropriately selected depending on the intended purpose, as long as the cleaning step is a step capable of removing the toner remained on the photoconductor. For example, the cleaning step can be performed by the cleaning unit.

<<Charge-Eliminating Unit and Charge-Eliminating Step>>

The charge-eliminating unit is not particularly limited and may be appropriately selected depending on the intended purpose, as long as the charge-eliminating unit is a unit configured to apply charge-eliminating bias to the photoconductor to eliminate the charge of the photoconductor. Examples of the charge-eliminating unit include charge-eliminating lamps.

The charge-eliminating step is not particularly limited and may be appropriately selected depending on the intended purpose, as long as the charge-eliminating step is a step including applying charge-eliminating bias to the photoconductor to eliminate the charge of the photoconductor. For example, the charge-eliminating step can be performed by the charge-eliminating unit.

<<Recycle Unit and Recycle Step>>

The recycle unit is not particularly limited and may be appropriately selected depending on the intended purpose, as long as the recycle unit is a unit configured to recycle the toner removed by the cleaning step to the developing device. Examples of the recycle unit include known conveying units.

The recycle step is not particularly limited and may be appropriately selected depending on the intended purpose, as long as the recycle step is a step including recycling the toner removed by the cleaning step to the developing device. For example, the recycle step can be performed by the recycle unit.

Next, one embodiment for carrying out a method for forming an image by the image forming apparatus of the present disclosure will be described with reference to FIG. 1.

The image forming apparatus 1 is a printer, but the image forming apparatus is not particularly limited as long as an image can be formed with a toner, such as photocopiers, facsimiles, and multifunction peripherals.

The image forming apparatus 1 includes a paper feeding unit 210, a conveying unit 220, an image formation unit 230, a transfer unit 240, and a fixing device 250.

The paper feeding unit 210 includes a paper feeding cassette 211 in which sheets of paper P to be fed are stacked, and a paper feeding roller 212 configured to feed, one by one, the sheets of the paper P stacked in the paper feeding cassette 211.

The conveying unit 220 includes rollers 221 configured to transport the paper P fed by the paper feeding roller 212 to the direction of the transfer unit 240, a pair of timing rollers 222 configured to stand-by with nipping an edge part of the sheet of paper P transported by the rollers 221, and send the sheet to the transfer unit 240 at the predetermined timing, and paper ejection rollers 223 configured to discharge the sheet of paper P on which a color toner image has been fixed to a paper ejection tray 224.

The image formation unit 230 includes an image formation unit Y configured to form an image using a developer including a yellow toner, an image formation unit C using a developer including a cyan toner, an image formation unit M using a developer including a magenta toner, an image formation unit K using a developer including a black toner, and an exposure device 233. The image formation unit Y, the image formation unit C, the image formation unit M, and the image formation unit K are disposed with the predetermined gaps in this order from the left side to the right side in FIG. 1.

Note that, in the case where an arbitrary image formation unit is mentioned among the image formation units (Y, C, M, and K), it is referred to as an image formation unit.

Moreover, the developer includes a toner and a carrier.

The mechanical structures of the four image formation units (Y, C, M, and K) are substantially the same, except that a developer for use in each image formation unit is different.

The transfer unit 240 includes a driving roller 241 and a driven roller 242, an intermediate transfer belt 243 capable of rotating in the anti-clock direction in FIG. 1 along the driving motion of the driving roller 241, primary transfer rollers (244Y, 244C, 244M, and 244K) disposed to face photoconductor drums (231Y, 231C, 231M, and 231K) with the intermediate transfer belt 243 being between each primary transfer roller and each photoconductor drum, and a secondary counter roller 245 and a secondary transfer roller 246 disposed to face each other with the intermediate transfer belt 243 being between the secondary counter roller and the secondary transfer roller at a transfer position of a toner image to paper.

The fixing device 250 includes a heater disposed inside the fixing device, and a pressure roller 252 configured to rotatably press a fixing belt 251 that heats paper P to thereby form a nip. As a result of the functions of the fixing device, heat and pressure are applied to a color toner image on the paper P and the color toner image is fixed. The paper P on which the color toner image has been fixed is ejected to the paper ejection tray 224 by the paper ejection rollers 223. As a result, a series of image formation processes are completed.

(Process Cartridge)

The process cartridge of the present disclosure includes a photoconductor and a developer unit that stores the developer and is configured to develop an electrostatic latent image formed on the photoconductor with the developer to form a toner image. The process cartridge is a device (part) detachably mounted in an image forming apparatus.

The process cartridge associated with the present disclosure is formed in a manner that the process cartridge is detachably mounted in various image forming apparatuses. The process cartridge includes at least a photoconductor configured to beat an electrostatic latent image, and a developing unit configured to develop the electrostatic latent image on the photoconductor with the developer of the present disclosure to form a toner image. Note that, the process cartridge of the present disclosure may further include other units according to the necessity.

The developing unit includes at least a developer storage unit that stores the developer of the present disclosure, and a developer bearing member configured to transport the developer as well as bearing the developer stored in the developer storage unit. Note that, the developing unit may further include a regulating member for regulating a thickness of the developer born on the developer bearing member.

Figure 2:
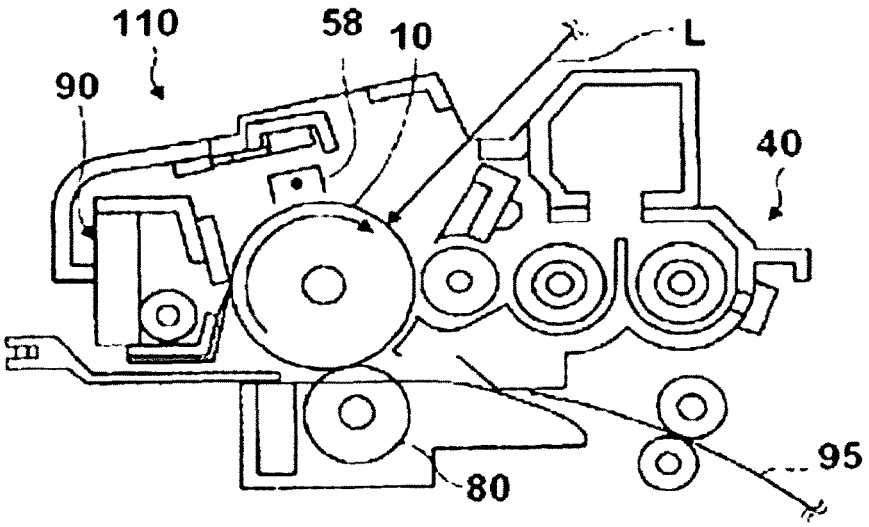
FIG. 2 is a schematic view illustrating one example of a process cartridge of the present disclosure.

One example of the process cartridge associated with the present disclosure is illustrated in FIG. 2. The process cartridge 110 includes a photoconductor drum 10, a corona discharger 58, a developing device 40, a transfer roller 80, and a cleaning device 90.

EXAMPLES

The present disclosure will be described in more detail by way of the following Examples. However, the present disclosure should not be construed as being limited to these Examples. Note that, "part(s)" denotes "part(s) by mass" unless otherwise stated.

Production Example 1

Synthesis of Amorphous Polyester Resin A1

A reaction tank equipped with a cooling tube, a stirrer, and a nitrogen inlet tube was charged with 352 parts of a bisphenol A ethylene oxide (2 mol) adduct, 149 parts of terephthalic acid, and 1.8 parts of tetrabutoxy titanate serving as a condensation catalyst. The resultant mixture was allowed to react for 6 hours at 230° C. under a nitrogen flow with removing generated water. Subsequently, the resultant was allowed to react for 1 hour under the reduced pressure of 5 mmHg through 20 mmHg until a weight average molecular weight of the reaction product reached 5,000, to thereby obtain Amorphous Polyester Resin A1 having glass transition temperature of 58° C. and a softening point of 100° C.

Production Example 2

Synthesis of Amorphous Polyester Resin B1

A reaction tank equipped with a cooling tube, a stirrer, and a nitrogen inlet tube was charged with 190 parts of a bisphenol A propylene oxide (2 mol) adduct, 176 parts of a bisphenol A ethylene oxide (2 mol) adduct, 105 parts of fumaric acid, and 1.8 parts of tetrabutoxy titanate serving as a condensation catalyst. The resultant mixture was allowed to react for 6 hours at 230° C. under a nitrogen flow with removing generated water. Subsequently, the resultant was allowed to react for 1 hour under the reduced pressure of 5 mmHg through 20 mmHg, followed by cooling to 180° C. Thereafter, 96 parts of trimellitic anhydride was added, and the resultant mixture was allowed to react under the reduced pressure of 5 mmHg through 20 mmHg until a weight average molecular weight of the reaction product reached 76,000, to thereby obtain Amorphous Polyester Resin B1 having glass transition temperature of 60° C. and a softening point of 153° C.

Production Example 3

Synthesis of Crystalline Polyester Resin C1

A reaction tank equipped with a cooling tube, a stirrer, and a nitrogen inlet tube was charged with 118 parts of 1,6-hexanediol, 104 parts of fumaric acid, and 1.8 parts of tetrabutoxy titanate serving as a condensation catalyst. The resultant mixture was allowed to react for 6 hours at 230° C. under a nitrogen flow with removing generated water. Subsequently, the resultant was allowed to react for 1 hour under the reduced pressure of 5 mmHg through 20 mmHg until a weight average molecular weight of the reaction product reached 5,000, to thereby obtain Crystalline Polyester Resin C1 having a melting point of 114° C. and a softening point of 111° C.

<Measuring Conditions of Glass Transition Temperature and Melting Point>

The obtained amorphous polyester resins and crystalline polyester resins were subjected to measurements of glass transition temperature and a melting point by means of a differential scanning calorimeter DSC-60 (available from Shimadzu Corporation) connected to a thermal analysis work station TA-60WS under the following conditions.

Sample container: aluminium sample pan (with a lid)
Amount of sample: 5 mg
Reference: aluminium sample pan (alumina: 10 mg)
Atmosphere: nitrogen (flow rate: 50 mL/min)
Heating and cooling conditions: as follows
- Starting temperature: 20° C.
- Heating speed: 10° C./min
- Termination temperature: 150° C.
- Retention time: none
- Cooling speed: 10° C./min
- Termination temperature: 20° C.
- Retention time: none
- Heating speed: 10° C./min (an endothermic peak observed in this heating process was determined as a melting point)
- Termination temperature: 150° C.

<Measurement of Softening Point>

Softening points of the obtained amorphous polyester resins and crystalline polyester resins were measured by means of a capillary rheometer flow tester (CFT-500, available from Shimadzu Corporation) as a temperature corresponding to ½ of from a flow onset point and a flow offset point when 1 $cm^3$ of a sample was melt flown under the conditions that a die pore diameter was 1 mm, applied pressure was 20 $kg/cm^2$, and heating speed was 6° C./min.

Example 1

A toner was produced using toner raw materials having the following composition.

Amorphous Polyester Resin A1: 67 parts
Amorphous Polyester Resin B1: 26 parts
Wax (WE-11, available from NOF CORPORATION): 6 parts
Addition polymerization-based resin (FB-676, available from (MITSUBISHI RAYON CO., LTD.): 6 parts
Carbon black: 13 parts
Zirconium salicylate derivative: 1 part Note that, a compound having the following structural formula (1) was used as the zirconium salicylate derivative.

Structural Formula (1)

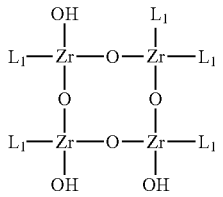

In Structural Formula (1), $L_1$ is a structure below.

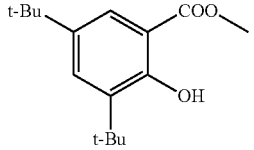

After pre-mixing the toner raw materials of the composition above by means of Henschel Mixer (FM20B, available from NIPPON COKE & ENGINEERING CO., LTD.), the resultant was melted and kneaded by means of a single screw kneader (a co-kneader available from BUSS) at 100° C. through 130° C.

After cooling the obtained kneaded product to room temperature, the kneaded product was roughly pulverized to the size of from 200 μm through 300 μm by Rotoplex.

The roughly pulverized particles were finely pulverized by means of a counter jet mill (100AFG available from HOSOKAWA MICRON CORPORATION) with appropriately adjusting pulverization air pressure to give a weight average particle diameter of 6.2 μm±0.3 μm. Thereafter, the resultant was classified by means of an air classifier (EJ-LABO available from MATSUBO Corporation) with appropriately adjusting an opening degree of a louver to give a weight average particle diameter of 7.0 μm±0.2 μm and a ratio (weight average particle diameter/number average particle diameter) of 1.20 or less, to thereby obtain Toner Base Particles 1.

Subsequently, to 100 parts of Toner Base Particles 1, additives, i.e., 1.0 part of (HDK-2000, available from Clariant) and 1.0 part of (H05TD, available from Clariant), were added, and the resultant mixture was stirred and mixed by means of Henschel Mixer, to thereby produce Toner 1.

Example 2

Toner 2 was produced in the same manner as in Example 1, except that the composition of the toner base particles was changed as follows.

Amorphous Polyester Resin A1: 65.5 parts
Amorphous Polyester Resin B1: 25 parts
Crystalline Polyester Resin C1: 2.5 parts
Wax (WE-1, available from NOF CORPORATION): 6 parts
Addition polymerization-based resin (FB-676, available from MITSUBISHI RAYON CO., LTD.): 6 parts
Carbon black: 13 parts
Zirconium salicylate derivative: 1 part Example 3

Toner 3 was produced in the same manner as in Example 1, except that the composition of the toner base particles was changed as follows.

Amorphous Polyester Resin A1: 67 parts
Amorphous Polyester Resin B1: 26 parts
Wax (WE-12, available from NOF CORPORATION): 6 parts
Addition polymerization-based resin (FB-676, available from MITSUBISHI RAYON CO., LTD.): 6 parts
Carbon black: 13 parts
Zirconium salicylate derivative: 1 part Example 4

Toner 4 was produced in the same manner as in Example 1, except that the composition of the toner base particles was changed as follows.

Amorphous Polyester Resin A1: 67 parts
Amorphous Polyester Resin B1: 26 parts
Wax (WEP-2, available from NOF CORPORATION): 6 parts
Addition polymerization-based resin (FB-676, available from MITSUBISHI RAYON CO., LTD.): 6 parts
Carbon black: 13 parts
Zirconium salicylate derivative: 1 part Example 5

Toner 5 was produced in the same manner as in Example 1, except that the composition of the toner base particles was changed as follows.

Amorphous Polyester Resin A1: 67 parts
Amorphous Polyester Resin B1: 26 parts
Wax (WEP-3, available from NOF CORPORATION): 6 parts
Addition polymerization-based resin (FB-676, available from MITSUBISHI RAYON CO., LTD.): 6 parts
Carbon black: 13 parts
Zirconium salicylate derivative: 1 part Example 6

Toner 6 was produced in the same manner as in Example 1, except that the composition of the toner base particles was changed as follows.

Amorphous Polyester Resin A1: 67 parts
Amorphous Polyester Resin B1: 26 parts
Wax (WEP-6, available from NOF CORPORATION): 6 parts
Addition polymerization-based resin (FB-676, available from MITSUBISHI RAYON CO., LTD.): 6 parts
Carbon black: 13 parts
Zirconium salicylate derivative: 1 part Example 7

Toner 7 was produced in the same manner as in Example 1, except that the composition of the toner base particles was changed as follows.

Amorphous Polyester Resin A1: 67 parts
Amorphous Polyester Resin B1: 26 parts
Wax (WEP-8, available from NOF CORPORATION): 6 parts
Addition polymerization-based resin (FB-676, available from MITSUBISHI RAYON CO., LTD.): 6 parts
Carbon black: 13 parts
Zirconium salicylate derivative: 1 part Example 8

Toner 8 was produced in the same manner as in Example 1, except that the composition of the toner base particles was changed as follows.

Amorphous Polyester Resin A1: 67 parts
Amorphous Polyester Resin B1: 26 parts
Carnauba wax: 6 parts
Addition polymerization-based resin (FB-676, available from MITSUBISHI RAYON CO., LTD.): 6 parts
Carbon black: 13 parts
Zirconium salicylate derivative: 1 part Comparative Example 1

Toner 9 was produced in the same manner as in Example 1, except that the composition of the toner base particles was changed as follows.

Amorphous Polyester Resin A1: 67 parts
Amorphous Polyester Resin B1: 26 parts
Wax (ALFLOW E-10, available from NOF CORPORATION): 6 parts Addition polymerization-based resin (FB-676, available from MITSUBISHI RAYON CO., LTD.): 6 parts
Carbon black: 13 parts
Zirconium salicylate derivative: 1 part Comparative Example 2

Toner 10 was produced in the same manner as in Example 1, except that the composition of the toner base particles was changed as follows.
Amorphous Polyester Resin A1: 67 parts
Amorphous Polyester Resin B1: 26 parts
Wax (WE-11, available from NOF CORPORATION): 6 parts
Addition polymerization-based resin (MB-2389, available from MITSUBISHI RAYON CO., LTD.): 6 parts
Carbon black: 13 parts
Zirconium salicylate derivative: 1 part Comparative Example 3

Toner 11 was produced in the same manner as in Example 1, except that the composition of the toner base particles was changed as follows.
Amorphous Polyester Resin A1: 67 parts
Amorphous Polyester Resin B1: 26 parts
Oxidized wax: 6 parts
Addition polymerization-based resin (FB-676, available from MITSUBISHI RAYON CO., LTD.): 6 parts
Carbon black: 13 parts
Zirconium salicylate derivative: 1 part <Ionic Strength Ratio of Wax>

To 5 g of the toner, 100 g of toluene was added, and the resultant was left to stand for 24 hours. Thereafter, a centrifugal process was performed at a rotational speed of 3,000 rpm by means of a centrifuge (HIMAC CP100NX, available from Hitachi, Ltd.), to sediment insoluble matter. Thereafter, the insoluble matter was separated through decantation, to thereby obtain the insoluble matter. To 1 g of the insoluble matter, 20 g of chloroform was added, and the resultant was left to stand for 24 hours. Thereafter, a centrifugation process was performed in the same manner as the above, to thereby remove insoluble matter. The resultant solution component was evaporated, dried and solidified. The obtained component was collected by 1 mg. The collected component was then dissolved in 1 mL of chloroform and the resultant solution was set to a mass spectrometer (JMS-T100GC, available from JEOL Ltd.). Then, a measurement was performed under the conditions that cathode voltage was −10 kv, a spectrum recording gap was 0.4 s, and a measuring mass range (m/z) was from 10 through 2,000, and a relative strength of each carbon number was calculated with regarding a total values of a strength of each carbon number of the ester compound as 100, to thereby confirm the maximum strength.

<Analysis of Type of Wax>

To 5 g of the toner, 100 g of toluene was added, and the resultant was left to stand for 24 hours. Thereafter, a centrifugal process was performed at a rotational speed of 3,000 rpm by means of a centrifuge (HIMAC CP100NX, available from Hitachi, Ltd.), to sediment insoluble matter. Thereafter, the insoluble matter was separated through decantation, to thereby obtain the insoluble matter. To 1 g of the insoluble matter, 20 g of chloroform was added, and the resultant was left to stand for 24 hours. Thereafter, a centrifugation process was performed in the same manner as the above, to thereby remove insoluble matter. The resultant solution component was evaporated, dried and solidified. The obtained component was analyzed in the following order by the following device under the following conditions.

[Treatment of Sample]

To about 1 mg of a sample, about 1 μL of a methylating agent [a 20% tetramethyl ammonium hydroxide (TMAH) methanol solution] was dripped, and the resultant was provided as a sample.

[Measuring Device and Measuring Conditions]
Measuring device: pyrolysis-gas chromatography-mass spectrometer (Py-GCMS)
Analysis device: QP2010 available from Shimadzu Corporation
Heating furnace: Py2020D available from Frontier Laboratories Ltd.
Heating temperature: 320° C.
Column: Ultra ALLOY-5 having a length of 30 m, an inner diameter of 0.25 mm, and a film thickness of 0.25 μm
Heating conditions: from 50° C. (retained for 1 minute), heating (10° C./min) to 340° C. (retained for 7 minutes)
Split ratio: 1:100
Column flow rate: 1.0 mL/min
Ionization method: EI method (70 eV)
Measuring mode: scan mode
Data for search: NIST 20 MASS SPECTRAL LIB.

<Measurement of SP Values of Amorphous Polyester Resin, Wax, and Addition Polymerization-Based Resin>

SP values of the amorphous polyester resin and the addition polymerization-based resin were measured as follows. To 5 g of the toner, 100 g of toluene was added, and the resultant was left to stand for 24 hours. Thereafter, a centrifugal process was performed at a rotational speed of 3,000 rpm by means of a centrifuge (HIMAC CP100NX, available from Hitachi, Ltd.), to sediment insoluble matter. Thereafter, the insoluble matter was separated through decantation. The resultant solution component was evaporated, dried, and solidified, and the obtained component was subjected to a component analysis through GC-MS to determine a constitutional unit (monomer composition).

For a measurement of an SP value of the wax, a type of the wax was determined in the same manner as in the above-described "Analysis of type of wax."

Based on the information of the monomer composition obtained by GC-MS, moreover, a quantitative analysis was performed. A measuring method, device, and conditions were as follows.

[Preparation of Sample]

(1) For $^{1}$H-NMR

In about 0.7 mL (d=1.48) of $CDCl_3$ including TMS, about 40 mg through about 50 mg of the sample was dissolved. The resultant was provided as a sample.

(2) For $^{13}$C-NMR

In about 0.7 mL (d=1.48) of $CDCl_3$ including TMS, about 250 mg through about 260 mg of the sample was dissolved. The resultant was provided as a sample.

[Measuring Device and Measuring Conditions]
Device: ECX-500 NMR, available from JEOL Ltd.
Measuring Conditions:
(1) Measuring nucleus: $^{1}$H (500 MHz), measuring pulse file: single pulse.ex2($^{1}$H), 45° pulse integration: 16 times, relaxation delay: 5 seconds, data point: 32 K, observation width: 15 ppm
(2) Measuring nucleus: $^{13}$C (125 MHz), measuring pulse file: single pulse dec.ex2 ($^{1}$H), 30° pulse integration: 1,000 times (1,039 times only for RNC-501), relaxation delay: 2 seconds, data point: 32 K, offset: 100 ppm, observation width: 250 ppm The monomer compositions of the amorphous polyester resin and addition polymerization-based resin in the toner were able to be confirmed by the GC-MS measurement and NMR measurement. Using the results of the monomer compositions, an SP value of each resin or wax was calculated according to the method of Fedor.

Physical properties of the toners obtained in Examples 1 to 8 and Comparative Examples 1 to 3 are presented in Table 1.

TABLE 1

| | Toner | SPr | SPw | SPd | SPr > SPw > SPd | \|SPr − SPw\| > \|SPw − SPd\| | Max strength ratio amount (%) | Wax | Melting point of wax (° C.) |
|---|---|---|---|---|---|---|---|---|---|
| Ex. 1 | Toner 1 | 11.1 | 8.6 | 7.8 | Satisfied | Satisfied | 97 | Monoester | 65 |
| Ex. 2 | Toner 2 | 11.1 | 8.6 | 7.8 | Satisfied | Satisfied | 97 | Monoester | 65 |
| Ex. 3 | Toner 3 | 11.1 | 8.6 | 7.8 | Satisfied | Satisfied | 54 | Monoester | 71 |
| Ex. 4 | Toner 4 | 11.1 | 8.6 | 7.8 | Satisfied | Satisfied | 60 or greater | Polyvalent ester | 61 |
| Ex. 5 | Toner 5 | 11.1 | 8.6 | 7.8 | Satisfied | Satisfied | 62 | Polyvalent ester | 74 |
| Ex. 6 | Toner 6 | 11.1 | 8.9 | 7.8 | Satisfied | Satisfied | 60 or greater | Polyvalent ester | 76 |
| Ex. 7 | Toner 7 | 11.1 | 8.9 | 7.8 | Satisfied | Satisfied | 30 or greater but less than 60 | Polyvalent ester | 80 |
| Ex. 8 | Toner 8 | 11.1 | 9.3 | 7.8 | Satisfied | Satisfied | 50 or greater | Carnauba wax | 83 |
| Comp. Ex. 1 | Toner 9 | 11.1 | 10.0 | 7.8 | Satisfied | Not satisfied | 60 or greater | Amide wax | 74 |
| Comp. Ex. 2 | Toner 10 | 11.1 | 8.6 | 9.5 | Not satisfied | Satisfied | 97 | Monoester | 65 |
| Comp. Ex. 3 | Toner 11 | 11.1 | 9.1 | 9.0 | Satisfied | Satisfied | 60 or greater | Oxidized wax | 78 |

Each of the obtained toners was subjected to evaluations of "low-temperature fixing ability," "heat-resistant storage stability," "transfer properties," "durability," "toner grindability," and "environmental stability of charging" in the following manner. The evaluation results are presented in Table 2.

<Low-Temperature Fixing Ability>

By means of a low-temperature fixing photocopier (IMAGIO MF-6550, available from Ricoh Company Limited), a temperature at which cold offset stopped occurring (the temperature is referred to as T2 (° C.) hereinafter) was measured with various a temperature of a fixing roller to a higher temperature side. When a standard usage temperature of the photocopier was determined as T1 (° C.), the low-temperature fixing ability of the toner was evaluated from the relationship between T1 and T2 based on the following evaluation criteria.

[Evaluation Criteria]

I: 30<(T1−T2)

II: 20<(T1−T2)≤30

III: (T1−T2)≤20

<Heat-Resistant Storage Stability: Penetration Degree>

A 10 mL-volume glass container was charged with 10 mL of each toner, and the glass container with the toner was left to stand for 24 hours in a thermostat of 50° C. Thereafter, the resultant was cooled to 25° C., and a penetration degree (mm) of the toner was measured by a penetration degree test (JIS K2235-1991). The result was evaluated based on the following evaluation criteria.

Note that, the larger the penetration is, more excellent heat-resistant storage stability is. When the penetration degree is less than 20 mm, a problem highly likely occurs on practical use.

[Evaluation Criteria]

I: 25 mm or greater

II: 20 mm or greater but less than 25 mm

III: less than 20 mm

<Transfer Properties>

By means of a low-temperature fixing photocopier (IMAGIO MF-6550, available from Ricoh Company Limited), an amount of the toner remained on the photoconductor (may also referred to as "transfer residue toner") was visually confirmed when the photocopier was stopped during the transfer to transfer paper. The result was evaluated based on the following evaluation criteria.

[Evaluation Criteria]

A: The transfer residue toner was less than 5% relative to a surface area of the photoconductor, and transfer properties were significantly excellent.

B: The transfer residue toner was 5% or greater but less than 10% relative to the surface area of the photoconductor, and transfer properties were excellent.

C: The transfer residue toner was 10% or greater but less than 15% relative to the surface area of the photoconductor.

D: The transfer residue toner was 15% or greater relative to the surface area of the photoconductor, and transfer properties were poor.

<Durability>

By means of a low-temperature fixing photocopier (IMAGIO MF-6550, available from Ricoh Company Limited), a test chart having an image area of 6% was printed on 100,000 sheets, and a degree of reduction in the charging amount of the developer was evaluated based on the following evaluation criteria.

[Evaluation Criteria]

A: The reduction in the charging amount was less than 5%, and durability was significantly excellent.

B: The reduction in the charging amount was 5% or greater but less than 10%, and durability was excellent.

C: The reduction in the charging amount was 10% or greater but less than 15%.

D: The reduction in the charging amount was 15% or greater, and durability was poor.

<Grindability of Toner>

When the roughly-pulverized product (screen-mesh: 1.5 mm) was pulverized a mechanical pulverizer (Turbomill T250) at 9,800 rpm, a volume average particle diameter was evaluated. The evaluation criteria was as follows.

[Evaluation Criteria]

A: less than 6.5 μm

B: 6.5 μm or greater but less than 7.0 μm

C: 7.0 μm or greater but less than 7.5 μm

D: 7.5 μm or greater

<Environmental Stability of Charging>

A charging amount of each of the produced toners was measured by a blow-off method in a low-temperature low-humidity room at 10° C. and 20% RH and in a high-temperature high-humidity room at 30° C. and 90% RH. A variation rate between the charging amount at the low temperature and low humidity and the charging amount at the high temperature and high humidity was calculated from the numerical formula below, and the variation rate was evaluated based on the following evaluation criteria.

$$\text{Variation rate (\%)} = \frac{LTLH\ \text{charging amount} - HTHH\ \text{charging amount}}{\{(LTLH\ \text{charging amount} + HTHH\ \text{charging amount})/2\}} \times 100$$

In the numeral formula, LTLH means low temperature and low humidity and HTHH means high temperature and high humidity.

[Evaluation Criteria]

I: less than 40%

II: 40% or greater but less than 70%

III: 70% or greater

TABLE 2

| | Toner | Low-temperature fixing ability | Heat-resistant storage stability | Transfer properties | Durability | Toner gridability | Environmental stability of charging |
|---|---|---|---|---|---|---|---|
| Ex. 1 | Toner 1 | I | I | A | A | A | I |
| Ex. 2 | Toner 2 | I | I | A | A | A | I |
| Ex. 3 | Toner 3 | I | I | B | B | B | I |
| Ex. 4 | Toner 4 | I | II | A | A | A | II |
| Ex. 5 | Toner 5 | I | I | A | A | A | II |
| Ex. 6 | Toner 6 | I | I | A | A | A | II |
| Ex. 7 | Toner 7 | II | I | B | B | B | II |
| Ex. 8 | Toner 8 | II | I | C | C | C | II |
| Comp. Ex. 1 | Toner 9 | I | III | D | D | D | III |
| Comp. Ex. 2 | Toner 10 | I | II | D | D | D | III |
| Comp. Ex. 3 | Toner 11 | II | I | C | C | C | III |

For example, aspects of the present disclosure are as follows.

<1> A toner for electrophotography, the toner including:

an amorphous polyester resin;

an addition polymerization-based resin; and wax that is ester wax or carnauba wax, wherein the toner satisfies relationships represented by Formula 1 and Formula 2 below, $$SPr > SPw > SPd \quad \text{(Formula 1)}$$

$$|SPr - SPw| > |SPw - SPd| \quad \text{(Formula 2)}$$

where SPr is a value of a solubility parameter of the amorphous polyester resin, SPw is a value of a solubility parameter of the wax, and SPd is a value of a solubility parameter of the addition polymerization-based resin.

<2> The toner for electrophotography according to <1>, wherein the wax is ester wax, and when an ionic strength ratio of each carbon number of the ester wax is represented with a percentage, an amount of an ester compound having the carbon number having a maximum ionic strength ratio is 60% by mass or greater relative to a total amount of the wax.

<3> The toner for electrophotography according to <1> or <2>, wherein the wax is ester wax, a melting point of the ester wax is 63° C. or higher but 78° C. or lower, and when an ionic strength ratio of each carbon number of the ester wax is represented with a percentage, an ester compound having the carbon number having a maximum ionic strength ratio is monoester wax.

<4> The toner for electrophotography according to any one of <1> to <3>, wherein glass transition temperature of the amorphous polyester resin is from 45° C. through 75° C.

<5> The toner for electrophotography according to any one of <1> to <4>, wherein a softening point of the amorphous polyester resin is from 90° C. through 150° C.

<6> The toner for electrophotography according to any one of <1> to <5>, wherein a weight average molecular weight of the amorphous polyester resin is from 1,000 through 100,000.

<7> The toner for electrophotography according to any one of <1> to <6>, wherein the amorphous polyester resin includes a constitutional unit derived from an aromatic compound.

<8> The toner for electrophotography according to <7>, wherein an amount of the constitutional unit derived from an aromatic compound is 50% by mass or greater relative to the amorphous polyester resin.

<9> The toner for electrophotography according to any one of <1> to <8>, wherein an amount of the amorphous polyester resin is from 75 parts by mass through 95 parts by mass relative to 100 parts by mass of the toner for electrophotography.

<10> The toner for electrophotography according to any one of <1> to <9>, wherein an amount of the wax is from 3 parts by mass to 40 parts by mass relative to 100 parts by mass of the amorphous polyester resin.

<11> The toner for electrophotography according to any one of <1> to <10>, wherein an amount of the addition polymerization-based resin is from 3 parts by mass through 40 parts by mass relative to 100 parts by mass of the amorphous polyester resin.

<12> The toner for electrophotography according to any one of <1> to <11>, further including a crystalline polyester resin.

<13> The toner for electrophotography according to any one of <1> to <12>, further including a charge-controlling agent.

<14> The toner for electrophotography according to any one of <1> to <13>, further including a colorant.

<15> The toner for electrophotography according to any one of <1> to <14>, further including external additives.

<16> A developer for electrophotography, the developer including:

the toner for electrophotography according to any one of <1> to <15>.

<17> The developer for electrophotography according to <16>, further including a carrier.

<18> An image forming apparatus including:

a photoconductor;

a charging unit configured to charge the photoconductor;

an exposure unit configured to expose the photoconductor charged to light to form an electrostatic latent image;

a developing unit that stores the developer according to <16> or <17> and is configured to develop the electrostatic latent image formed on the photoconductor with the developer to form a toner image;

a transfer unit configured to transfer a toner image formed on the photoconductor to a recording medium; and a fixing unit configured to fix the toner image transferred to the recording medium.

<19> A process cartridge including:

a photoconductor; and a developing unit that stores the developer according to <16> or <17> and is configured to develop an electrostatic latent image formed on the photoconductor with the developer to form a toner image, wherein the process cartridge is detachably mounted in a main body of an image forming apparatus.

The toner for electrophotography according to any one of <1> to <15>, the developer for electrophotography according to <16> or <17>, the image forming apparatus according to <18>, and the process cartridge according to <19> can solve the above-described various problems in the art and can achieve the object of the present disclosure.

What is claimed is:

1. A toner for electrophotography, the toner comprising:

an amorphous polyester resin;

an addition polymerization-based resin; and wax that is an ester wax or a carnauba wax, wherein:

the amount of the amorphous polyester resin is from 75 parts by mass through 95 parts by mass relative to 100 parts by mass of the toner; and the toner satisfies relationships represented by formulas (1) and (2):

(Formula 1) $SPr>SPw>SPd$ (1)

(Formula 2) $|SPr-SPw|>|SPw-SPd|$ (2), where:

SPr is a value of a solubility parameter of the amorphous polyester resin,

SPw is a value of a solubility parameter of the wax, and

SPd is a value of a solubility parameter of the addition polymerization-based resin.

2. The toner for electrophotography according to claim 1, wherein:

the wax is an ester wax; and the proportion of a main component of the ester wax is 60% by mass or greater relative to a total amount of the wax.

3. The toner for electrophotography according to claim 1, wherein:

the wax is an ester wax, a melting point of the ester wax is 63° C. or higher but 78° C. or lower; and the ester wax is a monoester wax.

4. A developer for electrophotography, the developer comprising:

the toner for electrophotography according to claim 1.

5. The toner according to claim 1, wherein the toner exists as a sea-island phase-separated structure in which the addition polymerization-based resin and the wax are in the form of islands dispersed in a sea of the amorphous polyester resin.

6. An image forming apparatus, comprising:

a photoconductor;

a charging unit configured to charge the photoconductor;

an exposure unit configured to expose the photoconductor charged to light to form an electrostatic latent image;

a developing unit that stores the developer according to claim 4 and is configured to develop the electrostatic latent image formed on the photoconductor with the developer to form a toner image;

a transfer unit configured to transfer a toner image formed on the photoconductor to a recording medium; and a fixing unit configured to fix the toner image transferred to the recording medium.

7. A process cartridge, comprising:

a photoconductor; and a developing unit that stores the developer according to claim 4 and is configured to develop an electrostatic latent image formed on the photoconductor with the developer to form a toner image, wherein the process cartridge is detachably mounted in a main body of an image forming apparatus.

* * * * *